US006160192A

United States Patent [19]

Lenglet et al.

[11] Patent Number: 6,160,192

[45] Date of Patent: Dec. 12, 2000

[54] STEAM CRACKING INSTALLATION AND METHOD WITH SINGLE CONTROLLED INJECTION OF SOLID PARTICLES IN A QUENCHING EXCHANGER

[75] Inventors: Eric Lenglet, La Celle Saint Cloud; Jean-Pierre Burzynski, Sainte-Foy-les Lyon; Gérard Courteheuse, Rueil-Malmaison; Roland Huin, Montesson la Borde; Yves Gougne, Givors, all of France

[73] Assignee: Institut Francais du Petrole, Rueil Malmaison Cedex, France

[21] Appl. No.: 09/202,787

[22] PCT Filed: Jun. 24, 1997

[86] PCT No.: PCT/FR97/01118

§ 371 Date: Mar. 8, 1999

§ 102(e) Date: Mar. 8, 1999

[87] PCT Pub. No.: WO97/49784

PCT Pub. Date: Dec. 31, 1997

[30] Foreign Application Priority Data

Jun. 25, 1996 [FR] France ..... 96 07871

[51] Int. Cl.[7] ..... C07C 4/04; C10G 9/16; C10G 9/20; F28D 7/00

[52] U.S. Cl. ..... 585/652; 585/648; 585/950; 208/48 R; 208/126; 208/130; 422/200; 422/201; 422/202; 422/207

[58] Field of Search ..... 422/200, 201, 422/202, 207; 208/48 R, 48 AA, 126, 130; 585/648, 652, 950

[56] References Cited

U.S. PATENT DOCUMENTS

| | | | |
|---|---|---|---|
| 5,177,292 | 1/1993 | Lenglet | 585/648 |
| 5,183,642 | 2/1993 | Lenglet | 422/213 |
| 5,186,815 | 2/1993 | Lenglet | 208/48 R |
| 5,820,747 | 10/1998 | Lenglet et al. | 208/130 |
| 5,965,013 | 10/1999 | Lenglet et al. | 208/130 |
| 5,972,206 | 10/1999 | Lenglet et al. | 208/130 |

FOREIGN PATENT DOCUMENTS

| | | |
|---|---|---|
| 1433702 | 2/1966 | France . |
| 90/12851 | 11/1990 | WIPO . |
| 96/20259 | 7/1996 | WIPO . |

*Primary Examiner*—Walter D. Griffin
*Attorney, Agent, or Firm*—Millen, White, Zelano & Branigan, P.C.

[57] ABSTRACT

A steam-cracking unit and a steam-cracking process with controlled injection of solid particles in a quenching exchanger (3) is described. The particles are injected through a single axial injection pipe that is arranged on the axis of input cone (2) of the quenching exchanger, just upstream from an impact separator-diffuser (6) that comprises solid surfaces that are arranged opposite the transfer pipe of the cracked gases toward the exchanger; this impact separator-distributor is located in input cone (2) of the exchanger and is gas-permeable along a number of passages and at least 70% opaque when viewed from the transfer pipe.

13 Claims, 3 Drawing Sheets

STEAM CRACKING INSTALLATION AND METHOD WITH SINGLE CONTROLLED INJECTION OF SOLID PARTICLES IN A QUENCHING EXCHANGER

FIELD OF THE INVENTION

The invention relates to a hydrocarbon steam-cracking unit and an operating process that comprises a decoking stage with controlled single injection of solid particles.

BACKGROUND OF THE INVENTION

The technological background is illustrated by Patents FR-A-1,433,702 and WO-A-96 20259.

The steam-cracking process is the basic process of the petrochemical industry and consists in cracking a feedstock of hydrocarbons and water vapor at high temperature and then abruptly cooling it. The main operating problem arises from the deposition of carbon-containing products on the inner walls of the unit. These deposits, which consist of coke or heavy pyrolysis tars that are condensed and more or less agglomerated, limit heat transfer in the cracking zone (in a pyrolysis pipe coil) and the indirect quenching zone (effluent quenching exchanger), thus requiring frequent shutdowns to decoke the unit.

In patents EP-A-419 643, EP-A-425 633 and EP-A 447 527 there is proposed a process for in-service decoking of steam-cracking units by injecting erosive solid particles in order to solve coking problems and to obtain continuous or approximately continuous steam cracking (for example, cycle periods on the order of 1 year).

The erosive solid particles can be injected upstream from the cracking zone of each furnace in order to scrape out the coke that is deposited in the pyrolysis pipes, and then downstream, the coke that is deposited in the effluent quenching exchangers.

The injections are carried out on line, i.e., either, preferably, during the normal operation of the furnace or during times when the hydrocarbon supply is interrupted briefly, whereby the furnace is then flushed with a stream of water vapor and is connected to the downstream sections of the unit (primary furnace, compression of cracked gases, etc.) This passage under vapor, in the absence of oxygen, can also be used for vapor decoking of the pipes of the furnace when it is carried out over longer periods of time. It is also possible to inject particles during air decoking periods, as air or air/vapor mixtures are being circulated in the unit.

To provide flexible steam cracking that is compatible with the use of heavy feedstocks (gas oil, distillate under vacuum) or olefinic feedstocks in an existing steam-cracking unit that is provided for cracking naphtha, it was found that it is essential to scrape out the coke that was deposited in the effluent quenching exchangers well and that in-service decoking of these quenching exchangers made it possible, unexpectedly, to make an existing steam-cracking unit compatible with a very wide variety of feedstocks and operating conditions. It was also found, unexpectedly, that the coke that was deposited in the quenching exchangers was much easier to eliminate by erosion than the coke in the pyrolysis pipes and that the previously proposed complete process for decoking of the unit by fine erosive particles was very difficult to implement in a reliable manner with flexible operation under inevitably variable conditions: the geometry of the pyrolysis pipes cannot in fact be suitable for all of the feedstocks to ensure correspondence between the erosive local intensity and the local coking speed (whereby the nature of the coke and its hardness can furthermore vary very greatly from one feedstock to the next); in contrast, with flexible operation, i.e., with variable operating conditions, type of feedstock and degree of dilution, the loss of load and the skin temperature of the pipes are no longer reliable indicators of the coking state of a bundle of pyrolysis pipes, and said coking state therefore cannot be known and monitored in real time.

SUMMARY OF THE INVENTION

To eliminate these drawbacks, a new process is proposed that combines at least predominantly chemical decoking (for example with air) of the pyrolysis pipes with decoking, at least partially by erosion, of quenching exchangers. This process therefore comprises erosive decoking of the quenching exchanger pipes, which requires suitable means for introducing erosive particles into these exchangers.

For the majority of units, these quenching exchangers (TLE) are of the multitube-type with a tubular input plate that can comprise, for example, 50 to 100 circulation pipes for cracked gases, whereby each pipe is cooled in most cases by circulation of pressurized water in an annular space around this pipe.

Each exchanger comprises an "input cone" of open-ended geometry that is connected to the transfer pipe for the cracked gases, which itself is connected to the pyrolysis pipes of the corresponding upstream cracking zone. This term input cone, which is used in a general way, should be considered to be non-limiting and represents the intermediate piece at the input of the exchanger that makes it possible to make the transition from the transfer pipe to the tubular plate of the exchanger, which has a much larger diameter. Said transition can be strictly cone-shaped, trumpet-shaped, or of other open-ended shapes.

The technical problem for which an object of the invention solution was found relates to the distribution of particles in the various pipes of the exchanger.

The process does not require a strictly uniform distribution of the amounts of particles in each pipe, but an attempt is made to provide relatively small distribution deviations, and it is necessary in particular to keep one of the pipes from receiving, for example, 10%, or else 10 times more particles than the mean value. Actually, a pipe that is poorly supplied with erosive particles can become clogged because of inadequate decoking, whereas a supercharged pipe would run the risk of being eroded by the excess particles.

The distribution of the particles should be carried out, furthermore, without causing significant erosion of the tubular plate of the exchanger.

This technical problem is made much more difficult by several process elements and constraints:

1) The very high temperatures (typically 850° C.) at the input of exchangers TLE.
2) The intense coking in this zone, with the risk of clogging of the input pipes by particles.
3) The very high circulation speeds and turbulence in this zone (typically 100 m/s and more).
4) The possible impact of solid coke fragments that are detached from the upstream walls, and
5) the relative vulnerability of the tubular input plate of the TLE, which has a thickness that is generally only about 10 mm, to erosion problems.

The device for introducing and distributing particles should therefore be, at the same time:

strong so as to withstand high temperatures, risks of impact and erosion, reliable, particularly with respect to problems of clogging by coke, high-performing from the distribution standpoint, under local conditions of high turbulence, and not entailing major risk of erosion for the tubular plate.

Techniques for injecting and distributing powdered solids or sprayed liquids in a multitube exchanger are already known.

These techniques consist in producing a multipoint injection, by injection distributors, so as to distribute the solids or the liquids directly opposite the pipes of the exchanger. These injections are advantageously carried out with a considerable number of points (for example 15 or 20) or else equal in number to that of the pipes of the exchanger) to improve the distribution.

The injection distributors are pipes that are generally straight or circular and that comprise nozzles or injection orifices.

This known solution has been tested for the application in question and was quickly abandoned for multiple reasons:

deformation of the distributors, too fragile, successive clogging of injection of numerous points by coke, probably because of the aerodynamic disturbances between the various injection points due to intense turbulence and recirculation in the input cone of the exchanger; this turbulence can actually cause the shutdown of flow of some injection points and clogging thereof.

The technical problem is, in fact, very difficult to solve because the constraints are apparently contradictory:

If it is desired to distribute the particles approximately equally, it is logical to make an injection with a multipoint spatial distribution, with a large number of points; this poses the risk of clogging.

If a small number of injection points is used, the latter will be arranged particularly upstream (for example at 50 times the diameter of the pipe), so that the particles have time to be distributed correctly in the gas. In this case, the speeds of the particles are high because the particles have time to be greatly accelerated by the circulation of the gases at high speed, and there are risks of erosion of the tubular plate.

If a central impact separator is added opposite the transfer pipe to keep particles from directly impacting on the tubular plate, the particles then get around the latter at its periphery, and the distribution of the particles in the downstream pipes will be less favorable; in particular, the pipes that are arranged just behind the impact separator will be poorly supplied with particles.

One of the objects of the invention is to eliminate the drawbacks of the prior art and to address the technical problems that are mentioned above.

To solve these problems, French Patent Application No. 94/15744 and Patent Application PCT No. PCT/FR95/01721 already proposed a steam-cracking unit and a process that comprises the injection of solid particles directly at the input or in the input cone of a multitube quenching exchanger, just upstream from an impact separator-distributor that is arranged in the input cone and that is gas-permeable along a number of gas passages and at least 70% opaque when viewed from the input section of the cone.

This device offers a large number of advantages as regards the technical problems:

1) The particles, which are injected directly upstream from the impact separator-diffuser, do not have time to be completely accelerated before they impact on the impact separator-diffuser; this reduces the risks of erosion.

2) The impact separator-diffuser that comprises a number of gas passages makes it possible to diffuse the gases and the particles in a number of directions and to improve the distribution of particles in the various pipes of the exchanger.

3) The impact separator-diffuser, which is essentially opaque when viewed from upstream, keeps at least the bulk of the particles from directly impacting on the tubular plate; the particles that rebound against the impact separator-diffuser lose a portion of their kinetic energy, which reduces the erosion risks, and rebound at variable angles, which provides a dispersion effect and improves the distribution of the particles within the various pipes of the exchanger.

4) Finally, the permeability of the impact separator-diffuser makes it possible to supply correctly with particles the pipes that are arranged just behind the impact separator-diffuser.

In the above-mentioned patent applications, a number of injection points between 1 and 8, but preferably between 2 and 6 (of which there are enough to improve the distribution of particles) are described, whereby the injectors are oriented primarily in an approximately radial way, in directions that are directed toward the axis of the cone or close to this axis.

The above-described devices make it possible to achieve effectively the technical results that are desired, but at the cost of the presence of a number of injection pipes, which requires the use of a number of injection lines and upstream means for distributing particles between the various injection lines. These multiple injection lines, which each typically comprise a sectioning valve that is provided for the high temperatures of the downstream injection point (for example 850° C.), are therefore relatively complex and expensive.

The object of the unit and of the process according to the invention is to propose a technical solution to the problem at hand that is considerably simpler to implement and therefore also less expensive and more reliable.

A hydrocarbon steam-cracking unit that comprises at least one cracking furnace that comprises at least one cracking zone with at least one pyrolysis pipe that is connected downstream by a transfer pipe to an input cone of an effluent quenching exchanger of this zone of the multitube type with a tubular input plate is therefore proposed, characterized in that the unit comprises:

a) A particle impact separator-diffuser that comprises solid surfaces that are arranged opposite the transfer pipe inside of said input cone, whereby said impact separator-diffuser is gas-permeable along a number of gas passages, but at least 50% opaque and preferably at least 70% opaque when viewed from said transfer pipe that is located upstream, b) a single injection pipe of solid particles to ensure at least partial elimination of the coke that is deposited in the pipes of the exchanger, whereby said pipe empties at a point for introducing the particles that is located at a distance L upstream from the impact separator-diffuser and that does not exceed 2.5 times diameter D of the tubular plate of the quenching exchanger, whereby this injection pipe is, at least in its end portion, arranged approximately on the axis of the cone (or very close to this axis, without exceeding the scope of the invention.)

Thus, according to the invention, a single axial injection that is arranged directly upstream from the multitube quenching exchanger is used.

The scope of the invention will not be exceeded if other injection lines of particles that are located much further upstream, for example upstream from the pyrolysis pipes or primary quenching exchangers that are arranged upstream from the multitube exchanger, were used to inject small amounts compared to the main injection of particles at a distance of at least 10×D upstream from the tubular plate of the multitube exchanger, for example upstream from the pyrolysis pipes.

When the furnace comprises several tubular exchangers that are arranged in parallel, there will therefore be, according to the invention, several injection lines but one single line for each of the exchangers.

The term impact separator-diffuser refers to a solid, generally metal body that is located on the path of the flow and can deflect the gases in several directions and can cause a large portion of incident solid particles that are conveyed by the gases to impact directly on said separator, so as to keep these particles from directly impacting on the tubular plate that is arranged downstream.

Impact separator-diffuser, which is at least 70% opaque, is defined as an impact separator-diffuser at which at least 70% of the stream lines of the transfer pipe, extended in the cone parallel to the axis of this cone, meet the impact separator.

In other words, the projected surface area of the various elements of the impact separator-diffuser, over the end section of the transfer pipe, represents at least 70% of this section. (The section of the pipe is the surface area that is delimited by the circle that corresponds to the inside diameter of the transfer pipe just upstream from the cone, whereby the surface area is projected parallel to the axis of the cone). When the transfer pipe forms a Y-shaped part or an elbow, the section that is considered is that of the end portion of the pipe, downstream from the Y or from the elbow, parallel to the tubular plate.

The gas passages can be non-communicating or communicating, for example with ends of solid surfaces that constitute the impact separator-diffuser, as will be described later.

In a preferred way, distance L between the ends of the injector and the impact separator-diffuser is between 0.1×D and 1.5×D, whereby D is the diameter of the tubular plate and preferably between 0.15×D and 1.2×D.

The impact separator-diffuser will advantageously be approximately 90% opaque, viewed from the transfer pipe, and even 100% opaque.

The impact separator-diffuser advantageously comprises surfaces that are arranged according to two levels and offset in such a way that the surfaces at one level are opposite the spaces at the other level. Reference can be made particularly to Patent Application WO-A-96 20259, which is incorporated as a reference that describes various impact separator-diffusers and devices that are applicable to the invention.

According to a characteristic variant, the impact separator-diffuser comprises a number of rectilinear bars, preferably with a circular section, that are approximately parallel and are arranged according to at least two levels that are approximately perpendicular to the axis of the cone, whereby the bars are offset in such a way that the solid surfaces of the bars of one of said levels are approximately opposite the empty spaces at the other level.

According to a characteristic unit variant, the transfer pipe comprises an elbow that is arranged directly upstream from the input cone, whereby the injection pipe is connected to the transfer pipe right at this elbow.

According to another characteristic variant, the transfer line comprises two branches that are connected in a Y directly upstream from the input cone, whereby the injection pipe is connected to the transfer pipe right at the connecting point of the two branches that form a Y.

The invention also proposes a steam-cracking process in a steam-cracking unit, characterized in that erosive solid particles are injected, preferably intermittently, just upstream from a multitube quenching exchanger that comprises an input cone by a single injection line that is arranged approximately on the axis of the input cone of the exchanger in an amount that is adequate to limit the increase in temperature of the effluents of the exchanger to a value that is less than 100° C. per month and preferably less than 30° C. per month. The hydraulic decokings of the exchanger can thus be scheduled at intervals of at least 6 months and preferably at least 18 months.

The invention will be better understood from the following figures that diagrammatically illustrate the unit and various embodiments according to the invention, where:

BRIEF DESCRIPTION OF THE DRAWINGS

FIGS. 1, 2A, 2B, 3A, 3B, 4 and 5 depict various aspects of the invention as discussed below wherein FIGS. 2B and 3B are top views and the remaining FIGS. are vertical front views

DETAILED DESCRIPTION OF THE DRAWINGS

Figure 1:
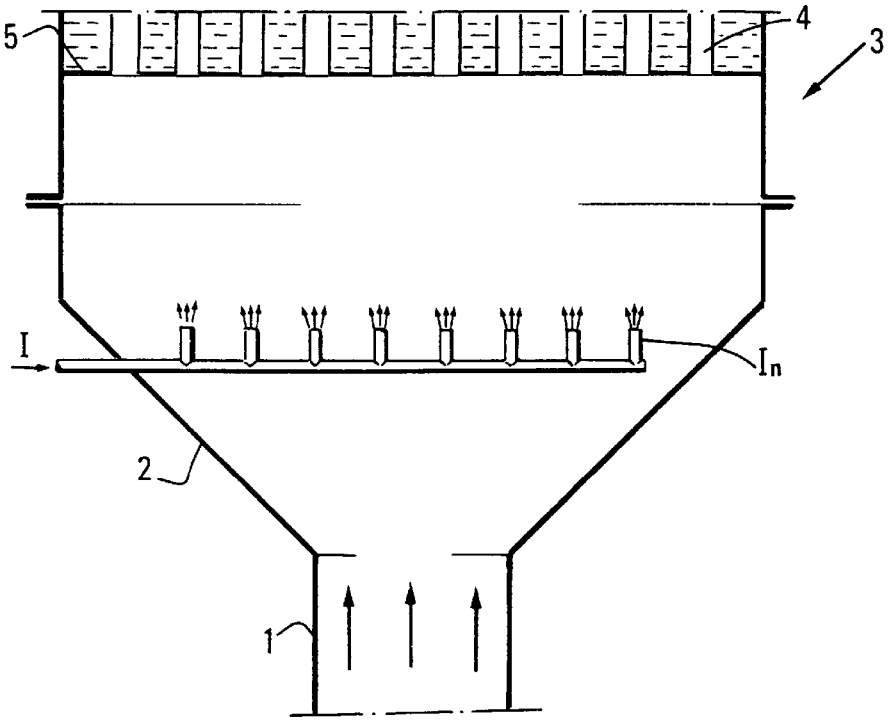

FIG. 1 presents a supply of particles, according to a known method of the prior art, with a multi-point spatial distribution.

According to FIG. 1, an indirect quenching exchanger (3) for the steam-cracking effluents that come from a cracking zone with pyrolysis pipes, not shown, is connected to this zone by a transfer pipe (1) that empties into input cone (2) of the exchanger. Said exchanger is of the multitube type and comprises a number of pipes (4) for circulation of cracked gases to ensure abrupt cooling of them, whereby said pipes are connected to a tubular plate (5).

Conventionally, to distribute particles and spread them out, injection distributors (I), one of which is shown, are used with a number of injection points (In) to ensure the spatial distribution of the particles.

The large number of points In and the thermal, aerodynamic and chemical (coking) conditions are very unfavorable for this device and cause in particular problems of clogging and deformation of distributors.

Figure 2A:
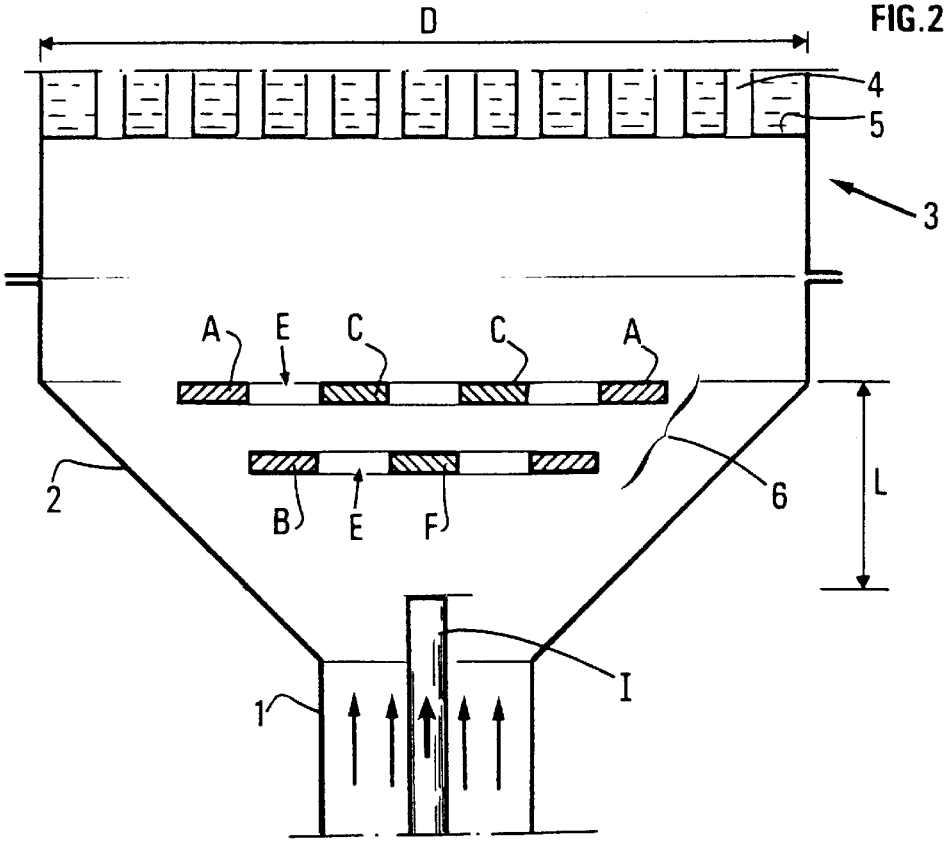
Figure 2B:
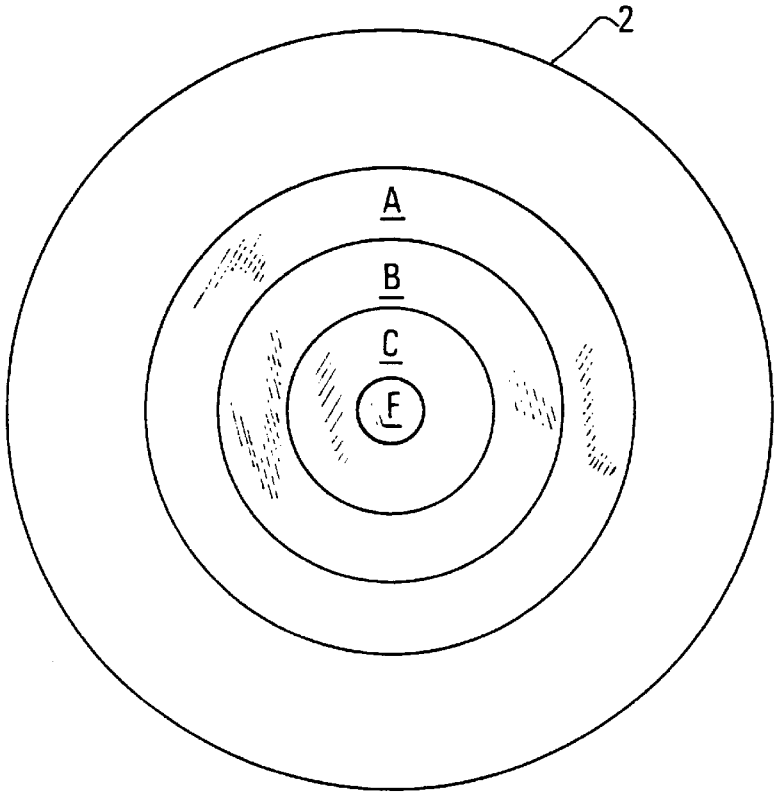

FIGS. 2A and 2B show the characteristic portion of a unit according to the invention. According to FIG. 2A, a single injector or injection pipe (I), which is typically tubular and arranged according to the axis of cone (2) and empties into the cone, makes it possible to inject particles just upstream from an impact separator-diffuser (6) that comprises a number of surfaces (A, B, C, F) as well as empty spaces (E) that form several gas passages. This impact separator-diffuser is located opposite transfer pipe (1), downstream from the stream lines of this transfer pipe, whereby said lines are symbolized by parallel arrows.

In examining FIG. 2A, it is seen that if the arrows that are located in transfer pipe (1) are extended, said arrows meet at least one of solid surfaces A, B, C, and F. Said impact separator-diffuser (6) is therefore 100% opaque when viewed from transfer line (1). It is still gas-permeable thanks to empty spaces (E) that form a number of gas passages. Advantageously, an impact separator-diffuser will be used that comprises a larger number of solid surfaces (for example between 8 and 20) and gas passages (E), which are not shown in this figure.

FIG. 2B diagrammatically illustrates a top view of surfaces ABCF of the impact separator-diffuser viewed from tubular plate (5).

According to the invention, the injection point, which is located at the end of injection pipe (I), is arranged at a small distance (L) upstream from the impact separator-diffuser (by definition, with a position defined by the most downstream solid surfaces). According to the figure, (L) is smaller than diameter (D) of tubular plate (5) of the exchanger.

As is also seen, this impact separator comprises two levels of solid surfaces: A and C, on the one hand, and B and F, on the other, whereby empty spaces (E) at one of the levels are approximately opposite the solid surfaces of the other level.

A, B, C, and F are either rectilinear bars or toric rings (A, B, C) or a disk (F) and have a rectangular section; they can be produced from a refractory alloy (for example HK 40) and connected to one another and to cone (2) by attachment lugs, or other mechanical devices, not shown.

Figure 3A:
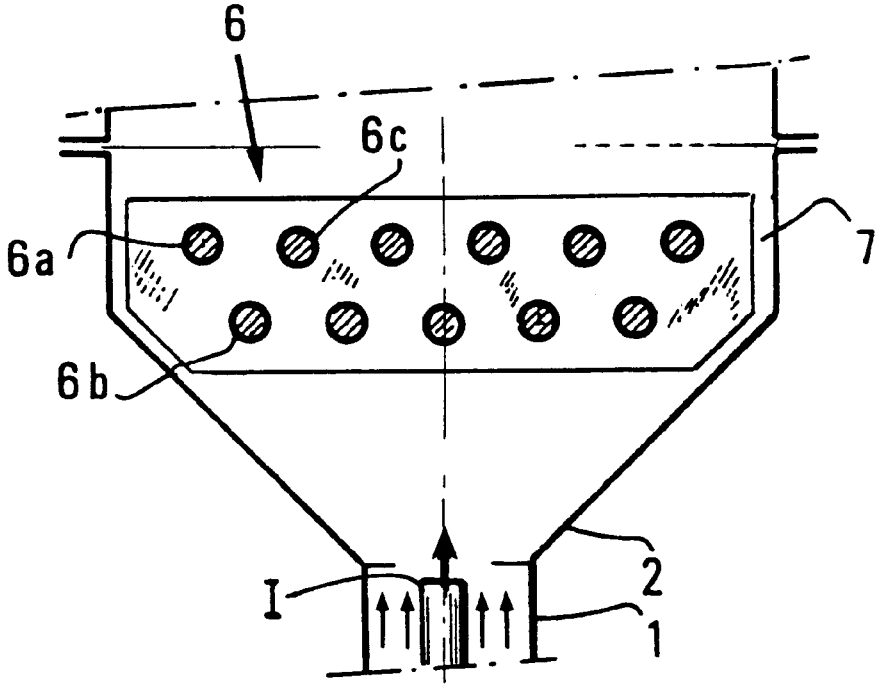
Figure 3B:
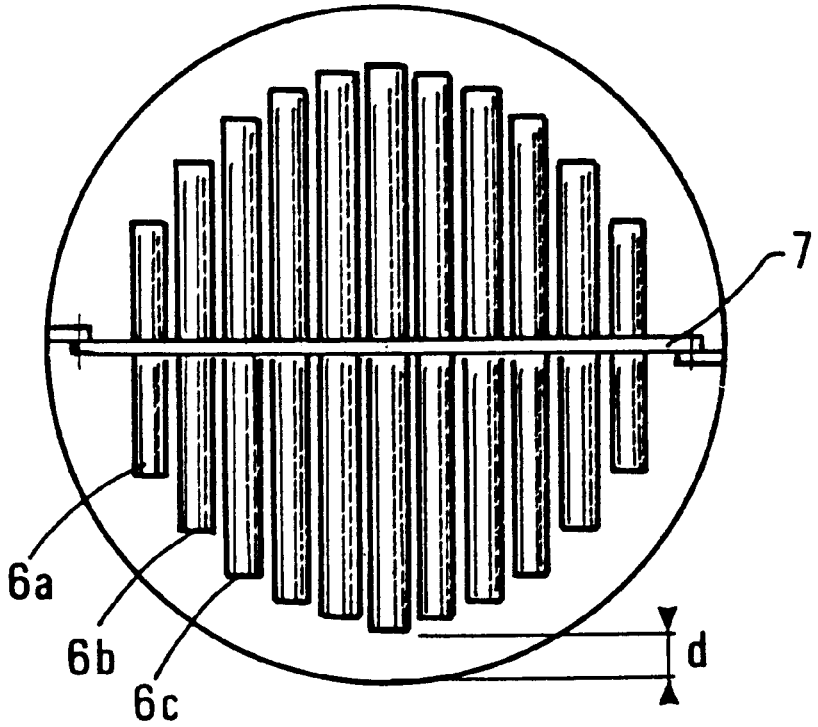

FIGS. 3A, 3B illustrate another impact separator-diffuser (6) variant that comprises a number of rectilinear bars (6*a*, 6*b*, 6*c*) that are approximately perpendicular to the axis of the exchanger, with a circular section, approximately parallel and arranged according to two levels. These bars are supported by a central single bracket (7) and are approximately perpendicular to the axis of the bars. The ends of the bars are located at distance d from the cone of at least 30 mm, and preferably 80 mm.

According to FIG. 3B, the projections of the bars are not contiguous, whereby the projected free space is at most 30% of the total space viewed from the pipe. Preferably, an impact separator that is totally opaque when viewed from upstream pipe (1) will be used, whereby the bars of one row occupy the space opposite the interstices of the other row.

Figure 4:
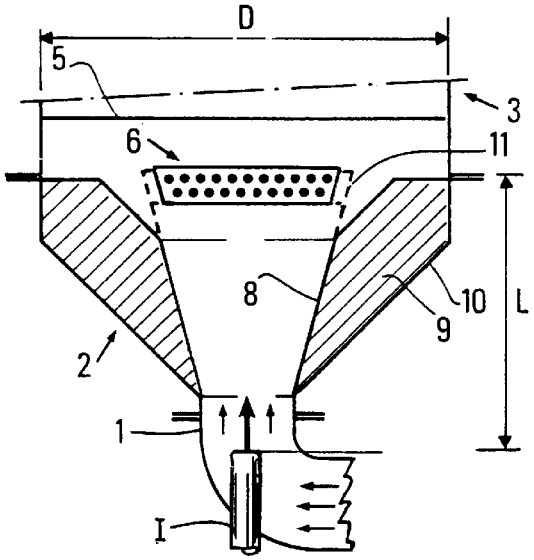

FIG. 4 shows a portion of a unit, according to a first characteristic variant.

Transfer pipe (1) for cracked gases comprises an elbow that is directly upstream from input cone (2) of the exchanger.

In a characteristic way, injection pipe (I), which empties inside the transfer pipe, is connected at the elbow; this makes it possible to inject the particles in the direction of the axis of the cone. This device is much more effective for distributing particles than a device where injection pipe (I) would make an elbow inside an axial transfer pipe (1). Impact separator-diffuser (6) comprises rectilinear bars that are perpendicular to the plane that is formed by the elbow and the axis of cone (2).

Cone (2) comprises an inside, approximately cone-shaped portion (8) that is made of a refractory metal alloy that empties opposite impact separator-diffuser (6). This impact separator-diffuser (6) is mechanically attached to inside cone (8) by attachment lugs (11), which are indicated by dotted lines. Refractory concrete (9) is arranged between inside metal cone (8) and outside metal wall (10) of cone (2) to reduce the free inside volume of cone (2) and to lower the temperature of the outside wall of cone (2).

Figure 5:
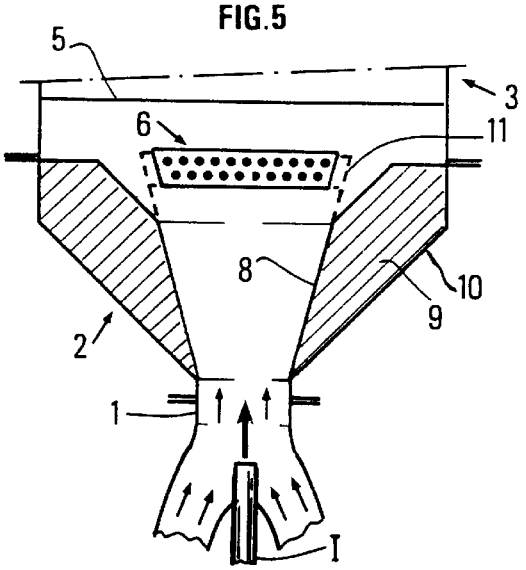

FIG. 5 represents a part of a unit according to another characteristic variant; transfer pipe (1) for cracked gases comprises two branches that are connected to one another by forming a Y, just upstream from input cone (2).

In a characteristic way, injection pipe (I) is connected to transfer pipe (1) that is approximately at the point of connecting two branches of the Y. This symmetrical arrangement ensures very high performance from the standpoint of the distribution of particles in the pipes of the exchanger.

The unit according to the invention operates in the following way: injection, preferably intermittent, of solid particles is carried out sequentially for each of the quenching exchangers (or furnaces that comprise several quenching exchangers). The erosive solid particles are conveyed by pneumatic transport toward injection pipes (I) by a carrier gas such as gas fuel, nitrogen, or water vapor. The particles can be supplied from a silo of new particles, or else they can be. separated downstream from the quenching exchangers and at least partially recycled. The pneumatic transport method can be a dense-phase or dilute-phase transport mode, in the continuous or pulsed mode, and can use means that are well known to one skilled in the art, such as valves, locks, feed screws, and shunting.

The particles that are injected into an exchanger by pipe (I) penetrate cone (2) but are not instantaneously dispersed by the flow of gas. The heterogeneous gas/particle mixture reaches the level of the impact separator-diffuser, where the gas is diffused by passages (E) (FIG. 2A) in several directions; the majority (50%, 70% or 90% or 100%) of the particles rebound against the solid surfaces of the impact separator-diffuser and are themselves diffused and dispersed secondarily through passages (E) and around the impact separator-diffuser and are distributed correctly into various pipes (4) of the exchanger.

The amounts of particles that need to be injected can be easily determined from the output temperature of the quenching exchanger; an attempt is made to limit the drift of said exchanger to a value of less than 30° C. per month, for example.

This injection method according to the invention, with a single injection pipe that is arranged approximately on the axis of the input cone of the exchanger and is directed approximately according to this axis, has unexpectedly proven to provide as high a performance as devices with multiple injection pipes, such as three or four pipes that are directed approximately radially.

Particle distribution deviations that are less than 20% relative to the mean value and are as good as with three or four injectors have been obtained in particular with impact separator-diffusers according to those of FIGS. 3A and 3B, which are approximately 100% opaque, and a single axial injection at 0.8×D upstream from the impact separator-diffuser, and this in a very simple, more reliable, and less expensive way.

What is claimed is:

1. A hydrocarbon steam-cracking unit that comprises at least one cracking furnace that comprises at least one cracking zone with at least one pyrolysis pipe that is connected downstream by a transfer pipe (1) to an input cone (2) of an effluent multitube quenching exchanger (3) of this zone with a tubular input plate (5), characterized in that the unit comprises:

a) a particle impact separator-diffuser (6) that comprises solid surfaces that are arranged opposite transfer pipe (1) inside of said input cone (2), whereby said impact separator-diffuser is gas-permeable along a number of gas passages, but at least 50% opaque when viewed from said transfer pipe (1) that is located upstream, and b) a single injection pipe (I) of solid particles to ensure at least partial elimination of the coke that is deposited in the pipes of exchanger (3), whereby the pipe empties at a point for introducing the particles that is located at a distance L upstream from the impact separator-diffuser that does not exceed 2.5 times diameter D of the tubular plate of the quenching exchanger, whereby this injection pipe is, at least in its end portion, arranged approximately on the axis of cone (2).

2. A steam-cracking unit according to claim 1, wherein distance L between the end of the injection pipe and the impact separator-diffuser is between 0.1×D and 1.5×D, whereby D is the diameter of the tubular plate.

3. A steam-cracking unit according to claim 2, wherein the distance L is between 0.15×D and 1.2×D.

4. A steam-cracking unit according to claim 1, wherein the impact separator-diffuser is at least about 90% opaque, viewed from transfer pipe (1).

5. A steam-cracking unit according to claim 1, wherein the impact separator-diffuser comprises a number of rectilinear bars (6*a*), (6*b*), (6*b*) which are approximately parallel and are arranged according to at least two levels that are approximately perpendicular to the axis of the cone, whereby the bars are offset in such a way that the solid surfaces of the bars of one of said levels are approximately opposite the empty spaces at the other levels.

6. A steam-cracking unit according to claim 5, wherein said rectilinear bars have a circular cross section.

7. A steam-cracking unit according to claim 1 that comprises a transfer pipe (1) that comprises an elbow that is arranged directly upstream from input cone (2), wherein injection pipe (I) is connected to transfer pipe (1) right at this elbow.

8. A steam-cracking unit according to claim 1 that comprises a transfer pipe (1) that comprises two branches that are connected in a Y directly upstream from input cone (2), wherein injection pipe (I) is connected to transfer pipe (1) right at the point connecting the two branches that form a Y.

9. A steam-cracking unit according to claim 1, wherein said impact separator-diffuser is at least 70% opaque.

10. A steam-cracking process in a unit according to claim 1, wherein erosive solid particles are injected just upstream from a multitube quenching exchanger by a single injection line (I) that is arranged approximately on the axis of input cone (2) of the exchanger in an amount that is adequate to limit the increase in temperature of the effluents of exchanger (3) to a value that is less than 100° C. per month.

11. A steam-cracking process according to claim 10, wherein said erosive solid particles are injected intermittently.

12. A stream-cracking process according to claim 10, wherein said increase in temperature of the effluent is a value less than 30° C. per month.

13. A steam-cracking process according to claim 10, wherein said multitube quenching exchanger is subjected to hydraulic decoking at intervals of at least six months.

* * * * *